United States Patent [19]

Tivelius

[11] 4,401,464

[45] Aug. 30, 1983

[54] INJECTION METALLURGY METHOD AND EQUIPMENT FOR ITS EXECUTION

[75] Inventor: Bertil G. Tivelius, Viken, Sweden

[73] Assignee: Scandinavian Lancers Aktiebolaget, Hoganas, Sweden

[21] Appl. No.: 367,794

[22] Filed: Apr. 12, 1982

[51] Int. Cl.[3] ..... C21C 7/10; C21C 5/52

[52] U.S. Cl. ..... 75/49; 266/158

[58] Field of Search ..... 75/49, 53; 266/158

[56] References Cited

U.S. PATENT DOCUMENTS 3,501,290 3/1970 Finkl ..... 75/49

*Primary Examiner*—P. D. Rosenberg

*Attorney, Agent, or Firm*—Murray and Whisenhunt

[57] ABSTRACT

The invention relates to a method and equipment of producing with good reproducibility steel which is extremely free from slag inclusions, particularly steel with low sulphur content and thus very low contents of sulphidic slag inclusions, starting with a steel melt which is decarburized in a melting furnace, converter or the like to the desired carbon content, after which subsequent refining is carried out by an injection method in a ladle.

15 Claims, 1 Drawing Figure

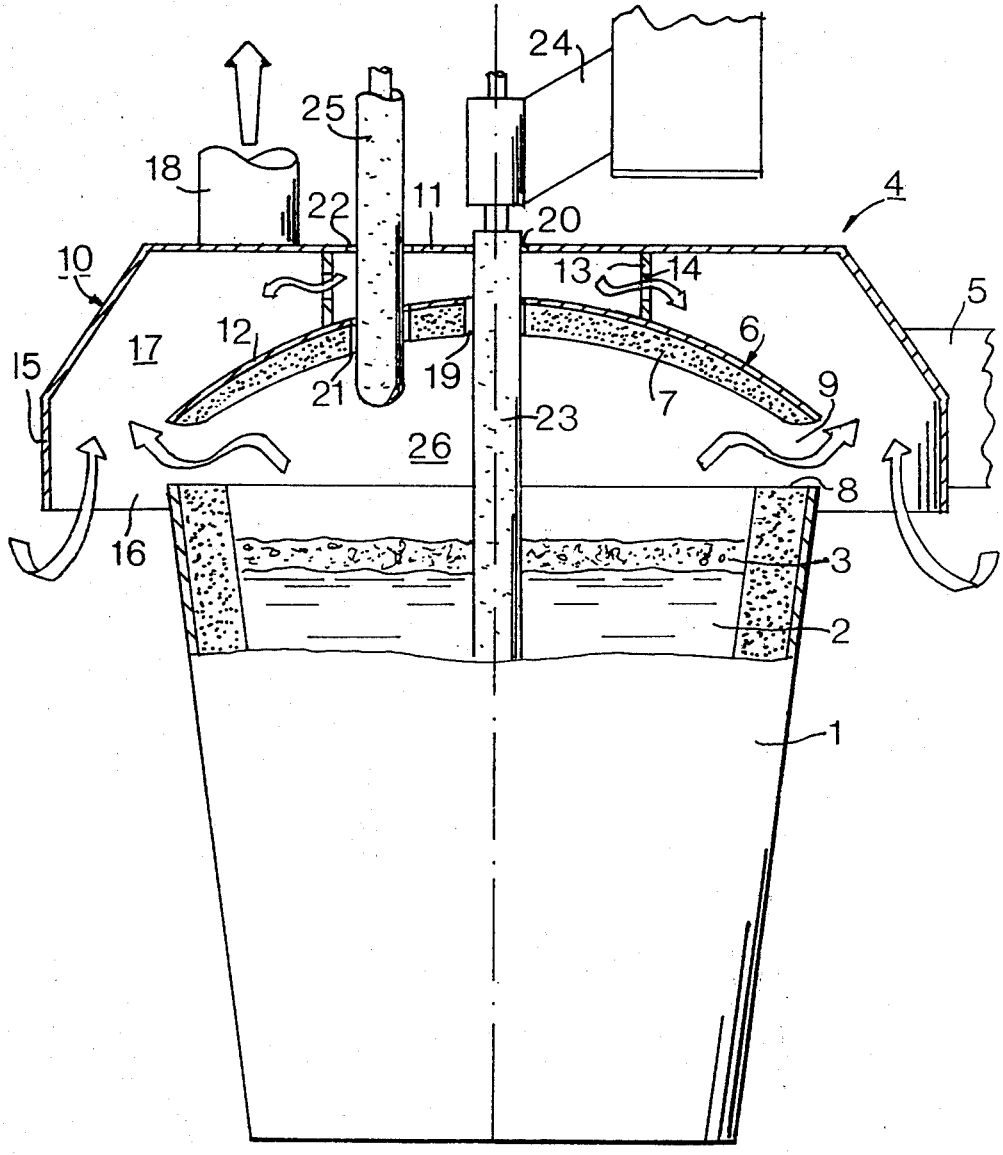
24
25
18
22
11
20
4
10
13
14
5
12
6
17
15
21
19
7
9
23
26
8
16
3
2
1

INJECTION METALLURGY METHOD AND EQUIPMENT FOR ITS EXECUTION

TECHNICAL FIELD

The invention relates to an improved injection metallurgy method. More particularly the invention relates to a method of producing steel which is extremely free from slag inclusions with good reproducibility, especially steel with very low sulphur content and hence low contents of suphidic inclusions. The starting material for the method is a steel melt which is refined in a melting furnace or in a converter to give the desired carbon content, after which subsequent refining is undertaken by an injection method in a ladle or corresponding treatment vessel. The invention also relates to equipment for carrying out the procedure.

BACKGROUND TO THE INVENTION

Injection technique is playing an increasingly important part in the metallurgy of steel for developing continuously improved qualities of steel. By injecting fine particle size calcium and/or magnesium compounds or metallic calcium and/or magnesium it has thus been possible for example to reduce the total content of sulphur in steel melts to extremely low values, i.e. less than 50 ppm. By choosing appropriate injection products it has also been possible to transform residual sulphides so that these become as harmless as possible. With the aid of injection metallurgy it has also been possible to reduce the content of oxidic inclusions to levels which could only be achieved with difficulty using techniques hitherto traditional. However in the search for improved grades of steel the requirement for extremely low sulphur contents has been imposed, i.e. not exceeding 20 ppm, which using methods known hitherto could not be achieved with good reproducibility without a deterioration in quality requirements other than the low sulphur content.

The problem outlined above is due to the dynamics of reactions of the type which take place between on the one hand the ladle lining the furnace slag and the atmosphere above the steel bath, and secondly the steel melt and those substances with a high oxygen affinity which are dissolved in the steel melt, and to the oxygen activity in the melt which is dependent on these reactions. The reaction from the ladle lining can be minimized by selecting a suitable refractory material, but the reaction from furnace slag residuals and by contact with the air so far have been difficult to control with good reproducibility. Obviously it has been possible to a considerable extent to influence the conditions by partly replacing the acid and usually FeO- rich furnace slag with a synthetic slag of high basicity, and also by de-oxidising the steel melt before any desulphurization substance is injected. With the methods and the technical aids available hitherto however it has not been possible to achieve such high accuracy during operations as to achieve with good reproducibility such extremely low sulphur contents as circa 200 ppm max.

DISCLOSURE OF INVENTION

The object of the invention is to provide an improved method which can solve the problems outlined above. One aim of the invention is also to provide a procedure whereby, with good reproducibility, it is possible to produce a steel even more free from slag than has been possible hitherto with the use of equal or less quantities of desulphurization substances than are consumed in the technology employed for producing steel with very low sulphur contents.

One aim of the invention is also to provide suitable equipment for executing the procedure.

These and other objectives can be achieved in that the refined steel melt is tapped into the ladle or corresponding treatment vessel accompanied by a minor, more or less uncontrolled quantity of high-oxide content, non-deoxidised furnace slag, that substantially lime, CaO, or a corresponding substance is added not later than in the ladle so as to together with the acid furnace slag form a synthetic slag with a composition having an optimal sulphur trapping capacity, that the necessary amount of aluminium is added during tapping or to the melt in the ladle so as to pre-reduce the slag, in order that the FeO content of the slag drops to not more than circa 3%, preferably to not more than circa 2%, and appropriately to not more than circa 1%, whilst at the same time the melt is purged with inert gas, that the oxygen content in the melt is measured after the said pre-reduction, that the ladle is covered by a hood not later than directly after measurement of the oxygen content, after which inert gas purging continues, whereby access of air to the ladle area above the surface of the melt is essentially prevented, whilst simultanously further aluminium is added, whereby the quantity of supplementary aluminium added is established as a function of the measured oxygen content in the melt so as to achieve complete de-oxidisation of the melt, that the melt is subsequently refined with respect to sulphur by injection of one or more desulphurization substances belonging to the group of substances comprising calcium alloys, magnesium alloys, calcium compounds, and magnesium compounds in one or several sequences, during simultaneous inert gas purging off the melt under the said hood, whereby the amount of desulphurization substance added is established as a function of analysis specimen, that if required the composition of the steel is modified by adding alloying substances, before, after or preferably simultaneously with the injection of the said desulphurization substance, that inert gas purging with the ladle continuously covered by the said hood is subsequently continued, whereby the slags are effectively separated from the melt to the slag cover, whilst at the same time re-oxidisation of the melt is effectively prevented so as to achieve a melt with extremely low sulphur content and freedom from slags, and that the melt is then finally casted, preferably by shielded casting.

By performing the method in the manner described above the oxygen activity of the steel melt can be kept under control and really complete de-oxidisation can be achieved before the sulphur-refining substances are injected, which is a pre-requisite if they are to exercise maximum effect subsequently. In accordance with the method oxygen samples of the melt are taken with the aid of oxygen probes after the furnace slag has been pre-reduced by adding a certain, empirically calculated, quantity of aluminium. By this means a good meaxure is obtained of how much additional aluminium needs to be added to achieve complete de-oxidisation. The remaining quantity of iron oxide or other metal oxides in the slag cover require only a marginal quantity of calcium, magnesium or the like to be completely eliminated by reduction during the course of desulphurization. It is also best to calculate the amount of aluminium added in conjunction with complete de-oxidisation so that after de-oxidisation is completed the desired minimum, alloying content of aluminium is present in the melt. The quantity of aluminium added to give complete de-oxidisation after taking the oxygen sample can be added by injection through lances. It is also feasible to employ other methods of adding the desired quantity of aluminium, e.g. by lancing, wire feed, etc.

Knowledged regarding the sulphur content, in the melt is obtained by means of analysis samples which suitably can be taken in the furnace or prior to or after de-oxidisation. When de-oxidisation has been completed and analysis samples have been taken from the melt it is possible to say that the conditions for continued refining of the melt as regards sulphur have been specified. For sulphur refining a plurality of calcium and magnesium compounds or alloys can be envisaged (and in theory also quite a number of other alkali metal compounds), although in actual practice mainly certain calcium compounds should normally be employed. For, inter alia, economic reasons mainly lime (CaO) can be considered. Calcium-silicon and/or calcium carbide power can be used for simultaneous transformation of the morphology of the inclusions, particularly with reference to shape control of sulphidic inclusions. Calcium cyanamide can be employed so as to simultaneously provide the steel with alloying nitrogen. Apart from these sulphur-refining substances it is also possible to inject different alloying substances, e.g. graphite powder for carburisation or ferroboron to add boron. To be able to simultaneously inject several substances into the melt it is possible to employ for example the method of two or more series-connected powder emitters as described in U.S. Pat. No. 3,998,625. The injection of calcium compounds can take place in one or several sequences. To achieve extremely low sulphur content in the melt without at the same time alloying the melt with excessively high contents of silicon it is possible for example to employ the sequential injection method described in U.S. Pat. No. 4,261,735, where injection can be initiated using for example lime, CaO, and terminated by the injection of calcium-silicon, CaSi, for controlling the shape of sulphide inclusions. Usually samples for analysis should be taken after deoxidisation is completed. To save time it is appropriate, directly after the analysis samples have been taken, to start injection of the sulphur-refining substance or substances, the substances modifying the alloying content being injected when the results of the analysis samples are obtained. On the other hand the sulphur content is known at an earlier point in time as a result of analysis samples which can be taken in the melting furnace or in the converter, because the sulphur content does not noticeably change during the pre-reduction of the furnace slag, although the content of alloying substances can however change.

In the method a fully or partially basic lined ladle is used. For example the ladle can be lined with dolomite. The equipment in accordance with the invention also comprises a hood which during refining is placed above the ladle. The hood contains on the one hand a heat shield which essentially completely covers the ladle, although a gap is left between the shield and the top edge of the ladle, and a screen which extends across and below the said gap so that a circumferential opening is formed between the screen and the ladle below the said gap. Furthermore at least one exhaust pipe is provided to communicate with the space under the said screen to suck out exhaust gases which pass from the ladle area out into the said space through the said gap, also air which is sucked in from the ambient atmosphere into the said space mainly through the circumferential opening between the screen and the outside of the ladle. Furthermore at least one aperture is provided in the hood for at least one lance which can be lowered into the space underneath the heat shield and/or into the melt in the ladle.

In accordance with a preferred embodiment the screen forms an all-enclosing roof over the heat shield, and the said aperture or apertures can also extend through the screen over the heat shield, whereby the entire space between the screen and the heat shield is arranged to be vented sucking-out through the said exhaust pipe. The equipment can also be designed for two lances, i.e. an injection lance and a gas purging lance, so arranged that they can be introduced simultaneously into the ladle area underneath the heat shield through two apertures through the hood. One lance aperture then is preferably arranged centrally, whilst the other aperture is displaced to the side.

The equipment described above carries out the functions necessary for the method, namely that it on the one hand prevents the inflow of air from the ambient atmosphere by maintaining an overpressure of, suitably, argon beneath the hood, so that re-oxidation can be prevented after de-oxidisation has been completed, and secondly it helps to keep up the temperature of the slag on the surface of the melt, which contributes towards the sulphur being effectively removed so as to give extremely low values in the melt. By preventing re-oxidisation of the melt and cooling down of the slag, a degree of freedom is also obtained for purging with inert gas after sulphur refining has been completed, to a greater extent than is possible conventionally. This signifies that an adequate period of time is obtained for being able to effectively separate the slags in the melt to the slag cover before the melt once again starts to be contaminated because of newly formed slag occasioned by the re-oxidisation which, although occurring gradually, cannot be completely eliminated. It is possible to state that with the present invention it is possible to stay longer at the higher slag purity level, which also provides sufficient time for various activities, e.g. temperature adjustment, analysis adjustment or quite simply for such trivial activities as are normally encountered in the steel works, such as for example remedying minor faults in the casting machineries, waiting for a crane which is occupied for other purposes, etc.

DESCRIPTION OF THE PREFERRED EMBODIMENT

A detailed description with reference to the appended drawings which show a section through a ladle with a hood in accordance with the invention will now be given of a preferred embodiment of the equipment in accordance with the invention. The ladle has been generally designated as 1, a steel melt by 2 and a slag cover by 3. Above the ladle 1 a hood generally designated as 4 is provided. The hood 4 can rest, with the support provided for the purpose, on the upper edge of the ladle 1 or be kept in place by means of an arm 5 which can be raised, lowered and pivoted. As a third alternative the hood can be suspended in chains beneath a platform. The hood 4 consists of a heat shield 6 with ceramic lining which faces the slag cover 3. A gap between the heat shield 6 and the upper edge 8 of the ladle is designated as 9.

Above the heat shield 6 a screen 10 is provided having a central section 11 which is joined to the upper steel casing 12 of the heat shield by a circular intermediate wall 13 with apertures 14. From the central section 11 the screen 10 extends, by way of a peripheral section 15 beyond the edge 8 of the ladle 1 and down past the gap 9 to a level underneath the edge 8. The opening between the projecting portion of screen 10 and the outside of ladle 1 is designated as 16, whilst the space between the shield 6 and the screen 10 is designated as 17. An exhaust pipe 18 is connected to the space 17.

The heat shield 6 and the screen 10 are provided with two pairs of concentric apertures 19, 20 and 21, 22. The two first mentioned apertures 19, 20 are arranged centrally and are designed for an injection lance 23 with a lance manupulator 24, whilst the two other apertures 21, 22 are arranged at the side thereof and designed for a gas purging lance 25. Both lances 23 and 25 can be brought down into and up from the melt 2. The gas purging lance 25 can also be introduced into the ladle chamber underneath the heat shield 6 without being introduced into the melt 2.

During operation, whether the gas purging lance 25 is immersed in the melt or not, inert gas is supplied under pressure above atmospheric pressure to the ladle chamber 26 between the heat sheild 6 and the slag covering 3. The inert gas is supplied to the said space through the injection lance 23 and/or through the gas purging lance 25. The gases flow out through the gap 9 to the space 17 which is kept under vacuum in comparison with the ambient atmosphere by means of exhaustion through pipeline 18. At the same time a certain amount of air flows in through the opening 16, which air is mixed with the gases in the space 17 and is withdrawn together with the gases through pipeline 18, thus preventing any noticeable quantities of air flowing into the ladle chamber 26. By keeping the space 17 under vacuum, (underpressure) with reference to the ambient atmosphere, it is also ensured that no considerable quantities of air flow into the ladle chamber 26 through the lance apertures 19-22.

I claim:

1. Method of producing steel comprising transferring a steel melt which has been decarburized to a desired carbon content, together with a minor more or less uncontrolled quantity of high oxide content non-deoxidised acid furnace slag into a treatment vessel, transforming the acid furnace slag at a time not later than in said treatment vessel into a synthetic slag with high sulphur trapping capacity, pre-reducing the slag by addition of reduction agent to form a slag having an FeO content no more than about 3% while purging the melt with inert gas, measuring the oxygen content of the melt after the said pre-reduction, covering the treatment vessel with a hood directly after measuring said oxygen content while continuing inert gas purging to essentially prevent access of air to the interior of the treatment vessel above the surface of the melt, completely deoxidizing the melt by adding further reduction agent thereto while continuing said inert gas purging, wherein the amount of further reduction agent added is determined by the amount of oxygen content of the melt determined in said measuring step to be necessary for complete deoxidation, taking a melt sample and analysing same for sulphur content, thereafter refining the melt with respect to sulphur by injecting at least one member selected from the group consisting of a calcium compound, a calcium alloy, a magnesium compound and a magnesium alloy, while inert gas purging the melt under the hood, in an amount determined as a function of the analysis of said melt sample, and thereafter casting the melt, whereby said melt to be cast is effectively separated from slag while reoxidation of the melt is effectively prevented to achieve a melt of low sulphur content and substantially free of slag inclusions.

2. Method as in claim 1, characterised in that refining is undertaken in a ladle having a wholly or partially basic lining.

3. Method as in one of claims 1 or 2, characterised in that an inert gas overpressure is maintained in the ladle space (26) with reference to the ambient atmosphere under said hood during said injection and thereafter.

4. Method as in claim 3, characterised in that a vacuum—i.e. an under-pressure with reference to the ambient atmosphere—is maintained in a space (17) between a heat shield (6) covering the ladle and a screen (10) covering said heat shield and an opening between the upper edge of the ladle and said heat shield.

5. Equipment for producing steel melts with very low contents of sulphidic and oxidic slags inclusions, comprising a ladle and a hood arranged above the ladle, characterised in that the hood (4) comprises a heat shield (6) which essentially covers the ladle completely, where a gap (9) is left between the heat shield and the upper edge (8) of the ladle; a screen (10) which extends over and underneath the said gap so that a circumferential opening (16) is formed between the screen and the ladle underneath the said gap, that at least one exhaust pipe (18) communicates with the chamber (17) under the said screen for sucking out exhaust gases which pass from the ladle chamber (26) out into the said space (17) through the said gap (9), and also air which is sucked from the ambient atmosphere into the said space (17) mainly through the circumferential opening (16) between the screen and the outside of the ladle, and at least one aperture (19-22) is provided in the hood for at least one lance (23, 25) which can be lowered into the space underneath the heat shield and/or into the melt in the ladle.

6. Equipment as in claim 5, characterised in that the screen forms an all-enveloping roof over the heat shield, that the said aperture or apertures also extend through the screen above the heat shield, and that the entire space between the screen and the heat shield is arranged to be ventilated by exhaustion through the said exhaust pipe.

7. Equipment as in claim 6, characterised in that an injection lance and a gaspurging lance are so arranged as to be capable of being introduced simultaneously into the ladle space under the heat shield through two apertures through the hood.

8. Equipment as in claim 7, characterised in that one lance aperture is arranged centrally whilst the other aperture is displaced towards the side.

9. Equipment as in one of claims 5-8, characterised in that means are provided for maintaining an inert gas overpressure in said ladle chamber (26) during said injection and thereafter prior to casting.

10. Equipment as in claim 9, characterised in that means are provided for maintaining a vacuum—i.e. an under-pressure with reference to the ambient atmosphere—in said space under said screen.

11. Method of claim 1, wherein the acid furnace slag is transformed into a synthetic slag by the addition of lime.

12. Method of claim 1, wherein the slag is prereduced so that the FeO content is not more than about 2%.

13. Method of claim 12, wherein said FeO content is not more than about 1%.

14. Method of claim 1, wherein the steel composition is modified by the addition of alloying substances before, with or after said melt refining step.

15. Method of claim 1, wherein the final melt casting is an inert gas shielded casting.

* * * * *